US007757990B2

(12) United States Patent
Tiitta et al.

(10) Patent No.: US 7,757,990 B2
(45) Date of Patent: Jul. 20, 2010

(54) METHOD FOR CHANGING A REEL IN A REELING PROCESS OF A FIBER MATERIAL WEB AND A REEL CHANGE APPARATUS

(75) Inventors: Jari Tiitta, Kellokoski (FI); Pekka Ruha, Helsinki (FI); Topi Tynkkynen, Vantaa (FI); Tatu Pitkänen, Järvenpää (FI); Petteri Lannes, Jokela (FI); Teppo Kojo, Mäntsälä (FI); Hannu Kasula, Kerava (FI); Matti Kemppainen, Jokela (FI)

(73) Assignee: Metso Paper, Inc., Helsinki (FI)

( * ) Notice: Subject to any disclaimer, the term of this patent is extended or adjusted under 35 U.S.C. 154(b) by 306 days.

(21) Appl. No.: 11/815,425

(22) PCT Filed: Feb. 3, 2006

(86) PCT No.: PCT/FI2006/000030

§ 371 (c)(1),
(2), (4) Date: Sep. 20, 2007

(87) PCT Pub. No.: WO2006/082278

PCT Pub. Date: Aug. 10, 2006

(65) Prior Publication Data

US 2008/0149757 A1 Jun. 26, 2008

(30) Foreign Application Priority Data

Feb. 3, 2005 (FI) ..... 20050122

(51) Int. Cl.
*B65H 19/28* (2006.01)

(52) U.S. Cl. ..... 242/532.3; 242/532.2; 242/541.4; 242/541.5

(58) Field of Classification Search ... 242/532.1–532.3, 242/541.4–541.5
See application file for complete search history.

(56) References Cited

U.S. PATENT DOCUMENTS

| | | | |
|---|---|---|---|
| 2,537,588 | A | 1/1951 | Husson |
| 3,321,149 | A | 5/1967 | Andersen et al. |
| 4,445,646 | A | 5/1984 | Karr et al. |
| 4,852,820 | A | 8/1989 | Looser |
| 5,360,179 | A | 11/1994 | Vesterinen et al. |

(Continued)

FOREIGN PATENT DOCUMENTS

| | | | |
|---|---|---|---|
| DE | 27 21 883 | A1 | 11/1978 |

(Continued)

*Primary Examiner*—Sang Kim
(74) *Attorney, Agent, or Firm*—Stiennon & Stiennon

(57) ABSTRACT

In a reel change in the reeling process of a fiber material web, the fiber material web (W) running to a reel that is becoming full is changed to run around a new reeling core (2) brought to a reel change position in such a way that the web is made to adhere onto the surface of the new reeling core (2). The web (W) is made to adhere onto the surface of the reeling core (2) by a change in the properties of the material on the surface of the reeling core (2). The material is a combination of an adhesive area (6*a*) on the surface of the reeling core and a protective layer (6*b*) on top of the adhesive area, and the properties of the material are changed by removing the protective layer (6*b*).

26 Claims, 14 Drawing Sheets

U.S. PATENT DOCUMENTS

| | | | | |
|---|---|---|---|---|
| 5,441,211 | A | 8/1995 | Ueda et al. | |
| 5,453,141 | A * | 9/1995 | Rodriguez | 156/184 |
| 5,531,396 | A * | 7/1996 | Kinnunen et al. | 242/526.3 |
| 6,474,589 | B1 * | 11/2002 | Enwald et al. | 242/527.2 |
| 6,547,178 | B2 * | 4/2003 | Rodriguuez | 242/526.2 |
| 6,572,600 | B1 | 6/2003 | Roe et al. | |
| 6,582,547 | B1 | 6/2003 | Gebekken et al. | |
| 6,739,545 | B2 * | 5/2004 | Drefs et al. | 242/542.3 |
| 7,128,289 | B2 * | 10/2006 | Perini | 242/532.2 |
| 2002/0134879 | A1 | 9/2002 | Rodriguuez | |
| 2004/0046080 | A1 | 3/2004 | Enwald et al. | |
| 2004/0135023 | A1 | 7/2004 | Bohm et al. | |
| 2005/0194489 | A1 | 9/2005 | Rodriguez | |

FOREIGN PATENT DOCUMENTS

| | | | |
|---|---|---|---|
| DE | 87 15 861.2 | U1 | 1/1988 |
| DE | 103 09 048 | A1 | 9/2004 |
| EP | 0 658 504 | A2 | 6/1995 |
| EP | 0 765 832 | A2 | 4/1997 |
| GB | 1211359 | | 11/1970 |
| WO | 90/13379 | A1 | 11/1990 |

* cited by examiner

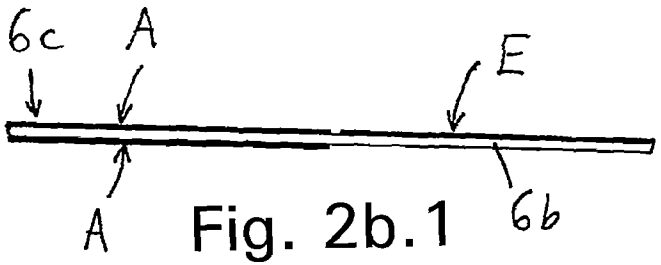
Fig. 2b.1
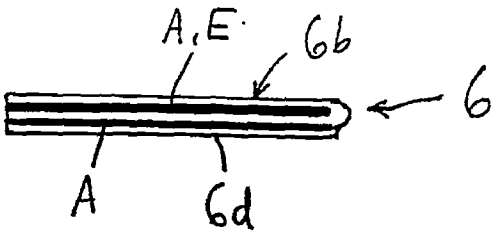
Fig. 2b.2
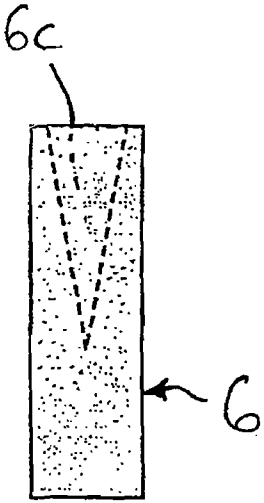
Fig. 2a.1
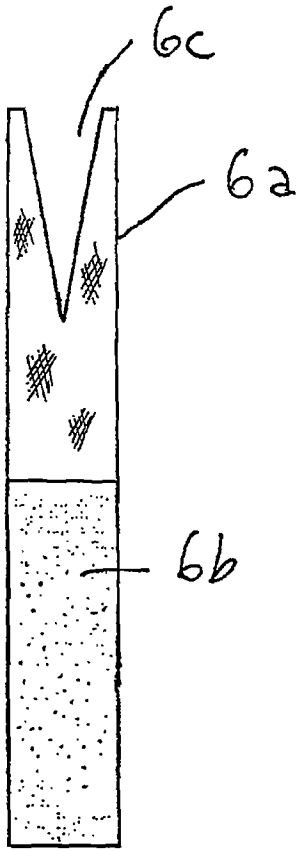
Fig. 2a.2

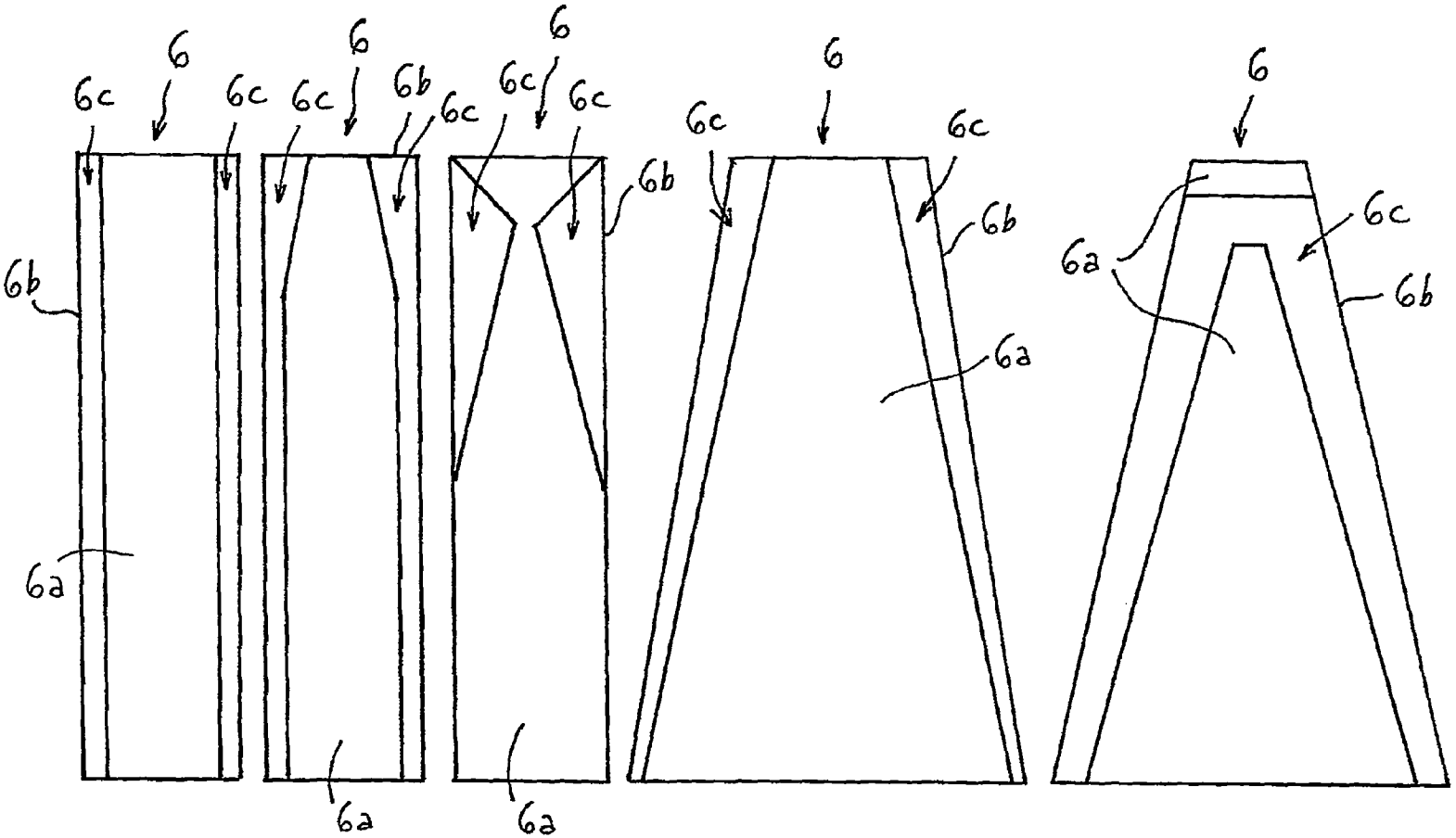
Fig. 7a.1 Fig. 7a.2 Fig. 7a.3 Fig. 7a.4 Fig. 7a.5

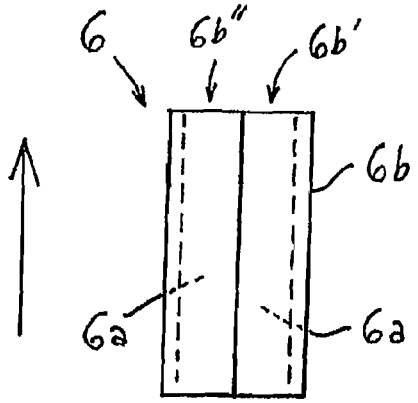
Fig. 7b.1
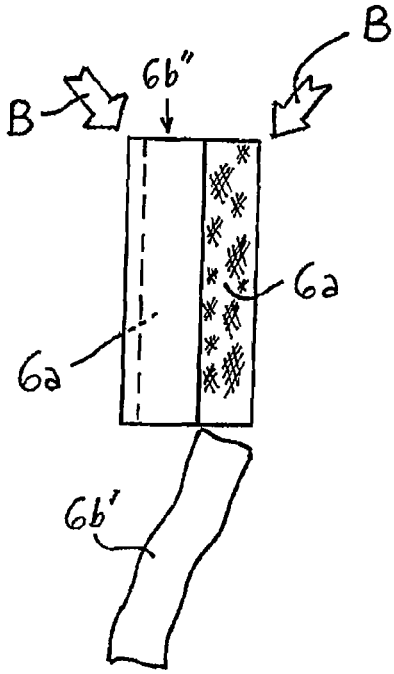
Fig. 7b.2
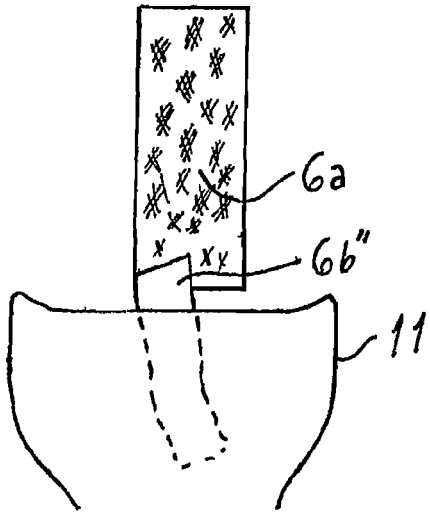
Fig.7b.3

METHOD FOR CHANGING A REEL IN A REELING PROCESS OF A FIBER MATERIAL WEB AND A REEL CHANGE APPARATUS

CROSS REFERENCES TO RELATED APPLICATIONS

This application is a U.S. national stage application of International App. No. PCT/FI2006/000030, filed Feb. 3, 2006, the disclosure of which is incorporated by reference herein, and claims priority on Finnish App. No. 20050122, filed Feb. 3, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for changing a reel in a reeling process of a fiber material web, for example in the reel-up of a paper or paperboard machine or a paper or paperboard finishing apparatus. In particular, the invention relates to a change in a continuous reel-up without reducing the running speed of the web.

In the reel-up of a paper machine, in a so-called pope reel-up or in a center drive assisted reel-up, finished paper is reeled around a reeling core, such as a reel spool, after the calender. The reeling itself is conducted in such a manner that the reeling core is loaded against a member for guiding the web, i.e. a reeling cylinder, via which the web to be reeled travels, winding around the reeling core and to form a complete reel. The reeling may take place by means of surface draw (the reeling cylinder or the like to be driven and simultaneously to rotate the reel) or a center drive (also the reeling core to be driven).

This section of the paper machine should also function without interruptions and receive the continuous paper web coming from the preceding sections of the paper machine. Thus, when the old reel has become full, it is necessary to cut the web and start to wind the web following the cutting point around a new reeling core. In practice, this takes place in such a manner that when the paper reel has become full, a new empty reeling core, i.e. for example a reel spool is transferred onto the surface of the reeling cylinder in contact with the paper web, whereafter the paper web is cut or brought to tear by means of a suitable method, and the end of the web following the cutting or tearing point is guided onto the periphery of the empty reeling core, on which the new reel now starts to accumulate.

The most critical phases in the reeling are, in fact, the cutting or tearing of the paper web running to the old reel at production speed and the act of bringing the new end of the web around the empty reeling core. To avoid unnecessary broke, the change must take place without problems. The ideal case is to bring the new end of the web immediately and neatly against the peripheral surface of the empty core, such as a reel spool, without extra loose pieces or creases of the web, because otherwise so-called bottom broke may be produced. It is well known that many methods are used for the change, depending on the grade or basis weight of the web to be reeled.

A generally used change method is pocket change which is suitable for all grades, but which typically causes quite a large amount of bottom broke and may cause harmful impacts in the reel-up. Another method is the so-called gooseneck change in which the above-mentioned problems are less severe, but which is suitable for thin grades only. A third method is the tape change, in which a tape is guided into the nip between the reeling core and the reeling cylinder in the vicinity of the ends of the reeling core and the reeling cylinder, whereafter the tape, as it winds spirally over the width of the reeling core, at the same time cuts the web diagonally and guides the new end following the cutting point of the web around the reeling core.

At present, the speeds of paper machines are generally 20 m/s or higher, and the aim is, of course, to attain even higher speeds. The cutting of a rapidly travelling web is not a problem as such, and forces caused by the speed can even be utilized in the cutting. The critical point is to bring the end of the new web immediately against the peripheral surface of the reel spool so that it follows the peripheral surface at a high peripheral speed, and to prevent the uncontrolled wandering of the end of the web and incorrect positioning of the same on the reel spool. This problem becomes worse when the basis weight is increased; in other words, greater forces must be used for "heavy" grades to overcome the inertial forces, i.e. to deflect the web from its original travel direction, which is towards the old reel.

On a continuously operating reel-up, the end of the web cannot be glued to the reeling core before the reeling begins, as is the case in reeling conducted by means of slitter winders, because when using known methods the glueing would require that the machine is stopped. In other respects, the glueing would be a secure way to pull the web around the new reeling core by means of its rotating motion. On the other hand, when applied as such, the glue acts in an uncontrolled manner, it may smear the surface of the reel spool, and it increases the need for cleaning. Furthermore, applied glues are also harmful in other respects, because some glue will adhere to the broke, and their repulpability is poor.

Changes carried out by air jets, in which it is possible to utilize a wedge or a tip cut from the web before the new reeling cylinder, or a band separated by two parallel incisions and a transverse incision by a blade in the area of the band, are presented, for example, in the patents EP 658 504, EP 765 832, U.S. Pat. No. 4,445,646, and U.S. Pat. No. 5,360,179.

U.S. Pat. No. 5,441,211 discloses a web change to a new reeling core by means of a slit in the cross direction of the web and a following adhesive area. The slit and the following adhesive area are produced in the web by a wheel placed before the change nip and equipped with a cutting edge and double-sided adhesive tape immediately following it. The transfer of the web around the new reeling core after the slit and the tearing of the web towards the edges are enhanced by a blow that takes place after the nip.

German application publication DE 2721883 also discloses a band separated in the central area of the web, to be cut after the change nip in the running direction of the web and to be blown around a new reeling core using a blade and a nozzle placed underneath the blade.

In general, the risk of a web break is involved in all the change methods in which the web running at full speed is touched before the change nip. This is the case when incisions are made by a blade or when an element, for example an adhesive piece, is attached to the web. For instance, an incision made by a blade, a "punching knife" before the change nip for the purpose of producing a slit, through which the web can be torn by blowing after the nip in the gooseneck change, is one example of such a change method involving a risk factor (for example, the gooseneck change presented as prior art in FIGS. A1 and A2 of U.S. Pat. No. 5,360,179).

The aim of the invention is to eliminate the above-mentioned drawbacks and to present a method by which the web can be brought safely around the new reeling core, without the application of a glue or without other smearing operations, or without bottom broke.

SUMMARY OF THE INVENTION

In the method, a material is applied that is placed onto the surface of the reeling core or the moving web. By changes in the properties of the material, which can be implemented during the reeling and when the paper web is running onto the old, full reel, a sufficient adhesion can be achieved between the reeling core and the web to produce, possibly with the help of other measures, the transfer of the web onto the surface of the reeling core after the change nip or a corresponding area of contact between the web and the reeling core.

According to an advantageous embodiment, this material is a piece with a two-layer structure which has a base layer and a protective layer and which can be placed onto the surface of the reeling core in advance, for example already before the transfer of the reeling core to the reel-up for a reel change. When the reeling core is in the change position, the protective layer is removed from the piece, exposing an adhesive area underneath the same to adhere the web to the surface of the reeling core. The removal of the protective layer, i.e. the change of the material to an adherent state, can be done when the reeling core is rotating, for example by using an air blow. For this purpose the piece is equipped with a suitable air pocket so that the blowing can be effective.

Other change methods according to the invention will be presented in the appended dependent claims and in the following description.

The change apparatus comprises a reeling core with a suitable structure, and/or a feeding or processing device arranged to supply the web with a material whose properties are changed in a way to promote the adhesion of the web or, respectively, to process the web and/or the reeling core in such a way that a change takes place in their properties to promote the adhesion between the web and the reeling core.

The adhesive tape according to the invention has a special structure and constitutes a material piece which can be easily attached to the surface of the reeling core before the reel change and which can be made to change its adhesive properties at a desired moment.

The invention provides change methods in which the web or a part of it is not touched mechanically before a change nip or a corresponding area of contact between the reeling core and the web. If cuts are made in the web in the longitudinal direction of the web, to separate the part intended for the change from the full-width web, a material jet, preferably a high-pressure water jet, is preferably directed to the surface of the web, to make said cut.

In this context, the word adhesion means the attractive force between the reeling core and the web, and it must not always be interpreted to be generated by means of a glue, but the meaning of the term becomes clear from each context.

The invention will be described in the following with reference to the appended drawings.

BRIEF DESCRIPTION OF THE DRAWINGS

FIGS. 1*a*-1*c* show cuts made in the web, which can be used in the embodiment of FIG. 1*a* but also in other embodiments.

FIGS. 2*a*.1, 2*a*.2, 2*b*.1 and 2*b*.2 show material pieces for use in the method of FIG. 1*a*.

FIG. 3*a* is a side view, and FIG. 3*b* is a top view.

FIGS. 7*a*.1-5 show other material pieces.

FIGS. 7*b*.1-3 show an arrangement for improving the change reliability.

DESCRIPTION OF THE PREFERRED EMBODIMENTS

Figure 1A:
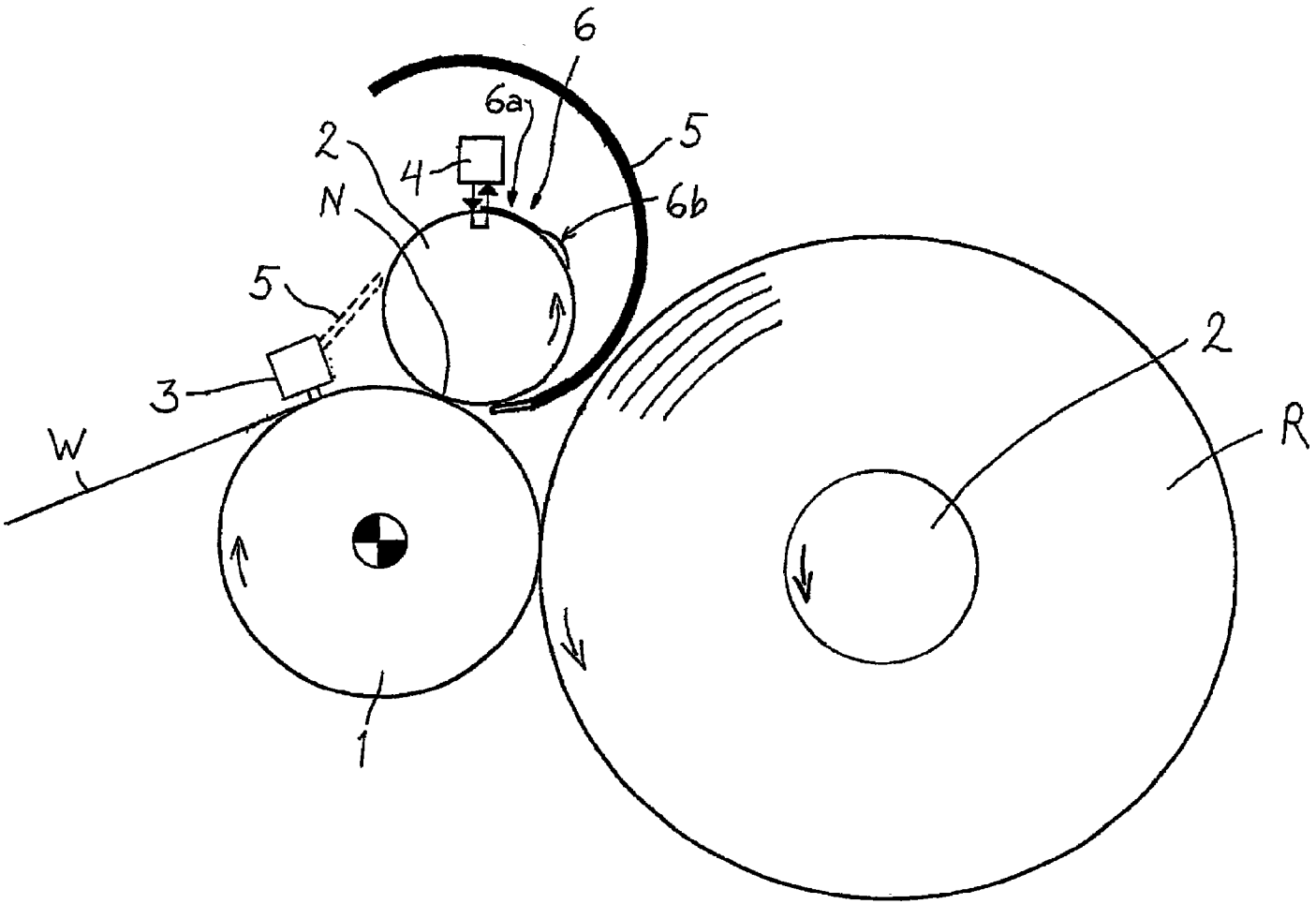
FIG. 1*a* is a side view of a reel-up, showing a change situation according to an advantageous embodiment of the invention.

In the situation of FIG. 1*a*, a new reel spool used as a new reeling core 2 has been brought to a reel change position, into connection with a fiber material web W, such as a paper web, running to an old reel that is becoming full, so that this connection makes the change possible. The reeling core 2 has been brought in contact with the paper web running on the surface of a web guiding member, a reeling cylinder 1, in such a way that it forms a change nip N with the web guiding member, rotating substantially at a peripheral speed that corresponds to the running speed of the web. After the change nip N between the reeling core 2 and the reeling cylinder 1, the web moves on the surface of the web guiding member to the actual reeling nip, through which it is wound onto the reel that is becoming full. Hereinbelow, the nip N refers to the nip formed in the change position, i.e. the change nip.

The reel change apparatus shown in FIG. 1*a* comprises a cutting device 3 placed before the new reeling core 2 in the travel direction of the web; a detector device 4 placed before the nip between the reeling core and the reeling cylinder in the direction of rotation of the new reeling core 2, in the figure above the reeling core 2; and a blow device 5 situated relatively soon after said nip (seen in the direction of rotation of the reeling core) before said detector device 4. The orifice of the blow device is directed against the direction of rotation of the reeling core, towards the gap opening after the nip N. The blow device may comprise a gooseneck known as such.

The cutting device 3 comprises preferably two cutting nozzles which are capable of piercing the web without a mechanical contact at the cutting point, by means of a material jet from the nozzle, and to produce a longitudinal cut in the web running forward at production speed in relation to the cutting point. The cutting nozzles are quickly movable in the transverse direction of the web, for example in a frame beam placed across the web. Preferably, the medium used for cutting the fiber material web is a high-pressure water jet.

FIG. 1*a* only shows one possible arrangement of the different parts. In principle, the detector device 4 may be placed anywhere, because it is used for calculating the location of a particular point on the periphery of the reeling core 2 during the rotation (particularly its location in relation to the nip N). The blow device shown in the figure is a known so-called gooseneck. However, the blow device 5 may be placed on the side of the so-called wet end, even in that case advantageously so that the direction of blowing is against the direction of rotation of the reeling core. It can be mounted e.g. to the frame beam of the cutting device 3 (alternative location shown by broken lines).

The surface of the reeling core 2 is provided with a material that is made adherent to the fiber material web 1 at a desired moment. This material may pass several rotations through the nip N in the change position without adhering to the fiber material web, but when the web should be made to run onto the surface of a new reeling core, the material is changed adherent to the web. In the change method shown in the figure, this is implemented by means of a double-sided adhesive tape 6 attached to the surface of the new reeling core and equipped with a protective layer. The protective layer 6*b* covers the adhesive area 6*a* in the base layer of the tape and thus comes against the web W in the nip N as the reeling core 2 rotates. When the material is to be brought to adherent state, the protective layer 6*b* is removed from the top of the adhesive area by means of the blow device 5. The figure shows a situation in which a blow by the blow device has caused the protective layer 6*b* to turn behind the adhesive area, seen in the direction of rotation, exposing the adhesive area 6*a*.

The method illustrated in FIG. 1*a* is performed in the following way: To perform a change, a blow is first used to open the adhesive tape, i.e. to remove its protective layer 6*b*, wherein the adhesive area 6*a* is exposed. The cutting device 3 is arranged to cut in the central area of the paper web a "tongue" or a tip extending in the direction of running of the web, i.e. a wedge whose rear part is attached to the web. The moment of cutting must be selected so that this tongue enters the nip at the same moment with the exposed adhesive area 6*a*. Thus, the tongue adheres to the adhesive area 6*a* and starts to follow the reeling core 2. Simultaneously, the web is cut off from the tongue all the way to the edges by the cutting device to make the whole web follow the tongue adhered to the surface of the reeling core without problems. To avoid the use of a tongue that is completely separate from the rest of the web at the front (in the case of thinner grades, with which problems may occur in entering the tongue neatly into the nip), a narrow band is cut by the cutting device 3, the front end of the band being attached to the web and the band being detached from the rest of the web only at edges. If the holding force of the adhesive area exceeds the tensile strength of the web, the tape is cut off when it is pulled along by the reeling core in the web, or it may be blown or cut off in another way after the nip. When the band is used, the widening movement of the cutting device 3 (the movement of the nozzles from the center towards the edges) is synchronized with the moment of entry of the adhesive area into the nip. One way of securing the cutting off of the tape is to cut from the web a very narrow band that is, for example, narrower than the width of the adhesive area 6*a*. The widening of the band wider than the adhesive area 6*a* by the cutting device is synchronized with the moment of entry of the adhesive area in the nip in such a way that the wider point enters the nip simultaneously with or just before the adhesive area 6*a*.

As the cutting device 3, it is possible to use the above-described water jet cutting device known as such, equipped with two nozzles moving under a suitable control, for example in a beam, in the cross direction of the web to shift the corresponding cutting point in the cross direction, and if the aim is to cut a tongue or a tip loose at the front, they are capable of "by-passing" each other in the central area of the web. In FIG. 1*a*, the cutting device 3 cuts the web with water jets against the surface of the reeling cylinder 1, but the device 3 can also be placed before the reeling cylinder 1, wherein the web can be supported from below by a separate supporting base, such as a plate, or a supporting wire running under the web on the reeling cylinder and through the nip N.

Figure 1B:
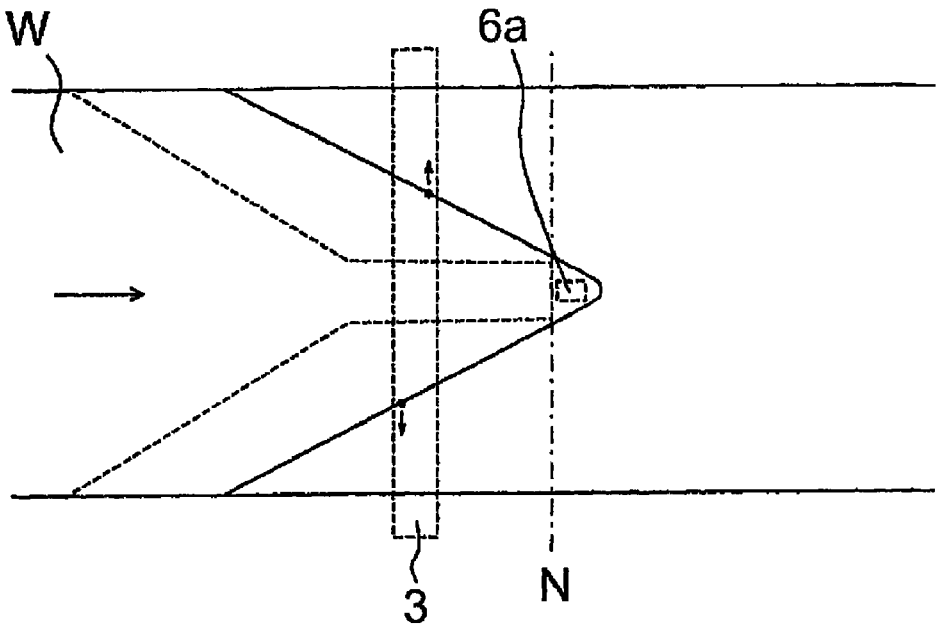
Figure 1C:
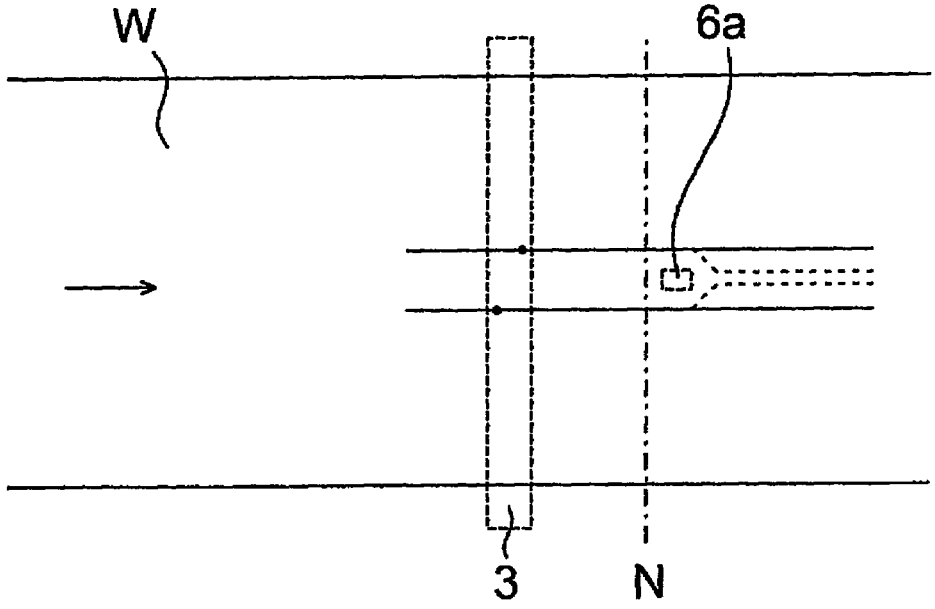

FIGS. 1*b* and 1*c* illustrate the change seen in directions perpendicular to the plane of the web. The location of the nip N (the point where the nip pressure starts to have an effect so that the adhesive area 6*a* and the web W adhere to each other) is marked with a dotted line. FIG. 1*b* shows the change by means of a tongue or a tip, a "wedge", and it shows that the widening to the edges of the web W may continue immediately after the formation of the tongue; for example, the cutting points may continue their movement to the edges uniformly right from the tip of the tongue, or it is possible to slow down or stop the motion and to perform the widening to the edges (broken line) first after detecting with certainty that the change has taken place (the tongue has been wound around the reeling core). FIG. 1*c*, in turn, illustrates the separation of the band with a uniform width from the web and its widening to the edges, and the broken line illustrates the formation of a narrower band before the point of attachment of the web, its widening wider than the adhesive area 6*a* before the point of attachment, and the widening to the edges after the point of attachment (adhesive area 6*a*).

The function of the cutting device 3 is synchronized in such a way that the detector device 4 detects the adhesive tape 6 on the surface of the reeling core while the reeling core 2 is rotating. This detector device detects the location of the adhesive tape 6 by means of a detectable feature relating to the location of the adhesive tape, giving a response to the detector device 4. Thus, it will be sufficient that a mark at the location of the tape is provided elsewhere in the reeling core, for example at the end of the reeling core, wherein also the detector device may be at the end of the reeling core. The mark may also be at a different point in the reeling core in the direction of the periphery, as long as the precise distance to the adhesive tape 6 is known. The detector device 4 may be, for example, a photocell, but it is also possible to use another detection method, preferably a contactless one. What is important is to know when the tape 6 passes through the nip N by means of a mark telling the location of the tape in an unambiguous way. Thus, with a fast control logic, it is possible to take the following steps: The removal of the protective layer 6*b* from the top of the adhesive area 6*a* and the synchronization of the cutting device 3 with said moment of removal in such a manner that a required cut is formed in the web by transferring the cutting points in the cross direction at the correct moment. Because the distance of the cutting device 3 from the nip N is known and the running speed of the web W is known, said events can always be synchronized correctly with each other. For example, it is possible to start the cutting of the web already before the material is made adherent (the adhesive layer 6*b* is removed), for example if the distance of the cutting device 3 from the nip N, measured along the web W, is greater than the distance between the point of removal of the adhesive layer 6*b* and the nip N, measured along the periphery of the reeling core (assuming that the running speed of the web is equal to the peripheral speed of the reeling core). As mentioned above, the correctly timed function of the cutting device 3 to move the cutting point in the cross direction of the web may be either the formation of a tongue or tip, loose at the front side, in the web, or, if a continuous band is formed by the cutting device, the timing of the transverse movement to widen the narrow band at least to the width of the adhesive area 6*a* or to start the widening at a relatively short distance from the point of adhesion of the band.

Consequently, the adhesive area 6*a* may pass several times through the nip N with the protective layer 6*b* on top of it, when the nip N between the new reeling core 2 and the web guiding member is closed. If some adhesive were exposed on the reel spool brought to the change position, the nip N should be closed at the correct moment when the tongue or tip enters the nip. Inaccuracy in this respect may result in malfunctions, such as premature adhesion or folding of the tongue, etc.

Figure 1D:
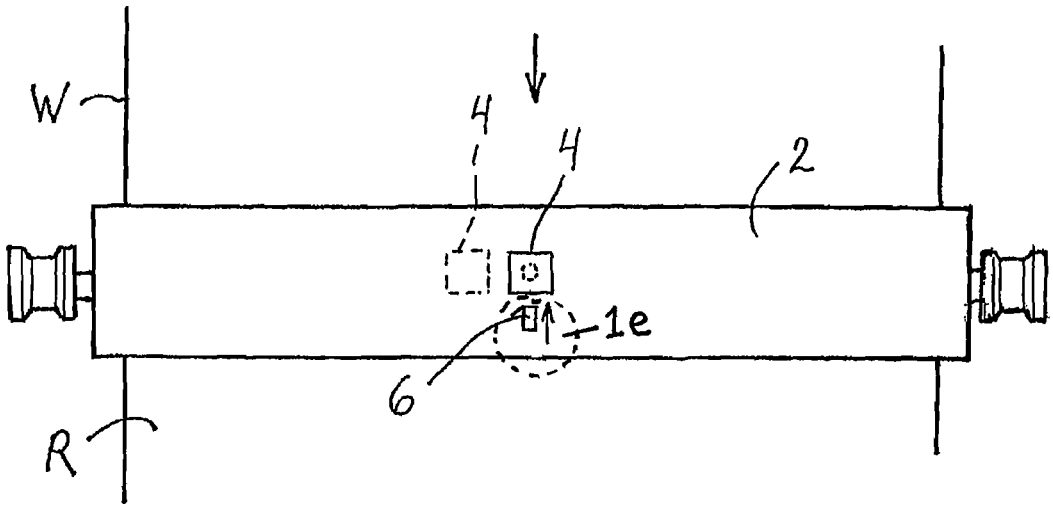
FIG. 1*d* is a top view showing an advantageous implementation for detecting a material piece for use in the change.
Figure 1E:
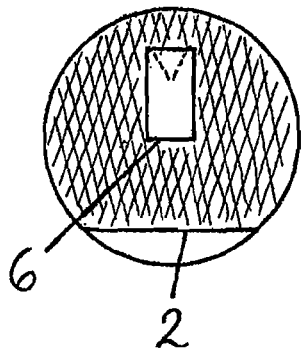
FIG. 1*e* is an enlarged portion of the view of FIG. 1*d* taken at region 1*e*.

FIGS. 1*d* and 1*e* show an advantageous arrangement in which the location of the adhesive tape 6 is detected during the rotation of the reeling core 2. This method is used to replace the above-mentioned other mark, which may be a reflector that is easily detected by a photocell of the detector device. In the arrangement shown in the figures, the tape 6 is detected directly by the detector device 4 which is located substantially at the same location as the adhesive tape 6 in the axial direction of the reeling core 2. Broken lines in FIG. 1*d* illustrate a situation in which the detector device 4 is slightly offset in the axial direction, for example because of disturbing reflections, but even in this situation, it is directed towards the outer surface of the reeling core 2, to detect the adhesive tape thereon. In practice, a direct detection of the tape is obtained by sufficient optical differences between the visible surface of the adhesive tape 6, that is, the outer surface of the protective layer 6*b*, and the outer surface of the reeling core 2. This is illustrated schematically in FIG. 1*e* showing a detail (the adhesive tape and the outer surface of the reeling core surrounding the same). The data on the location of the protective layer 6*b* is simultaneously the data on the location of the adhesive area 6*a* underneath the same. The detector device 4 may comprise a special photocell, i.e. a light detector that is capable of detecting the surface of the tape 6 that is light or reflects light well, from the darker or respectively poorly reflective background formed by the rest of the outer surface of the reeling core 2. The outer surface of the protective layer 6*b* of the adhesive tape 6 is made, for example, sufficiently light. The visible surface of the adhesive tape 6 (the outer surface of the protective layer 6*b*) can be formed, also in other respects, to have such a quality that it is optically detectable by a detector device 4 located farther away from the surface of the reeling core 2. The surface of the adhesive tape can be provided with a special property, for example with a specific color. For example, an adhesive tape 6 can be used that is equipped with a release paper (protective layer 6*b*) whose color is clearly different from the color of the outer surface of the reeling core 2. The adhesive tape can also be provided with a luminescence property, for example to be fluorescent, to form the color. Thus, the photocell is sensitive to the corresponding normal color or to the color given by the luminescence. The arrangement of the figure provides the advantage that before the transfer of the reeling core 2 to the change position, only the adhesive tape 6 needs to be placed on the reeling core 2, without any other auxiliary means to facilitate its detection, which makes the measures easier before the reel change when the reeling core is being prepared for the change, for example in a storage for reeling cores. Also, the placement of the adhesive tape always in the same location determined by a fixed identification mark is avoided, and consequently there is no risk of wearing or soiling of said location.

It is also possible that the difference required for the detection lies in the optical properties of the material (base layer) underneath the protective layer 6*b*, if the transparency of the paper of the protective layer is sufficiently high for the wavelengths, at which the detection takes place. Similarly, in this context, light and the related term "optical" refer not only to the range of visible light but also the boundary UV and IR ranges.

FIG. 2*a*.1 shows the structure of the adhesive tape 6, with the protective layer 6*b* on top of the adhesive area. FIG. 2*a*.2 shows the adhesive area 6*a* consisting of an adhesive material exposed after the blowing. The protective layer 6*b* is placed on the adhesive area 6*a* in such a way that a gap, a so-called "air pocket" 6*c* is formed under the front edge of the protective layer, to which the blowing can be directed, and when air penetrates under the protective layer 6*b*, the protective layer is made to tear off the adhesive area 6*a*. The air pocket 6*c* is such in nature that the air resistance caused by the rotary movement of the reeling core does not release the protective layer but it is released only by a sufficiently strong blow. In practice, a suitable air pocket can be formed by providing the front part of the adhesive tape with an area where the protective layer 6*b* is opposite the surface of the reeling core 2 without the base layer of the tape 6 in between; this is shown in the figures by providing the base layer with a wedge-like backwards narrowing cut-off portion that is covered by the protective layer 6*b*.

Figure 3A:
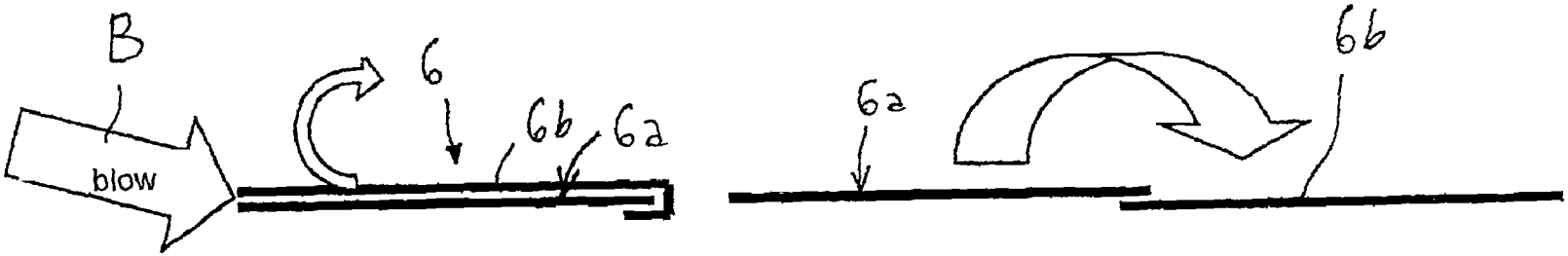
FIGS. 3*a* and 3*b* show the function of the material piece of FIGS. 2*a*.1, 2*a*.2 in a change situation.
Figure 3B:
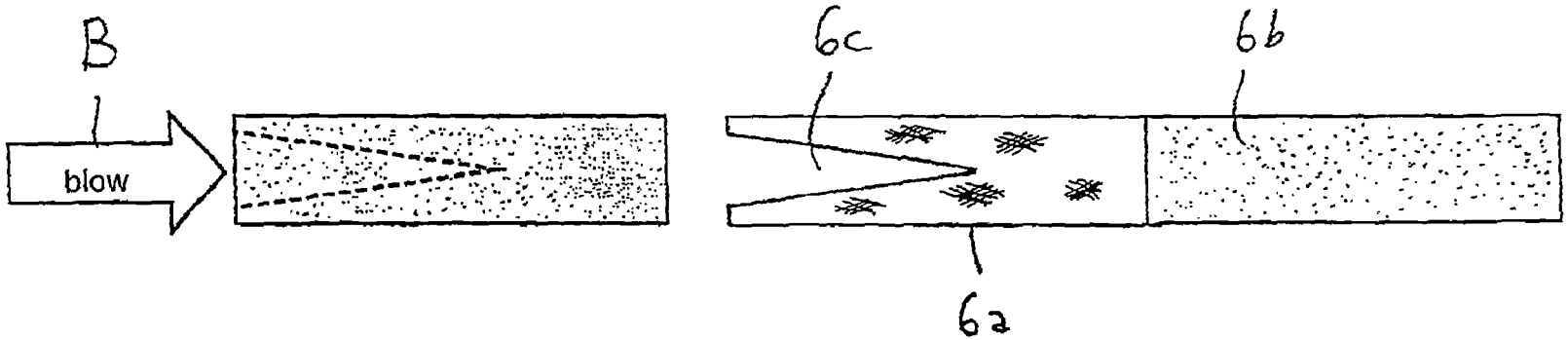
Figures 4A, 4B, 4C, 4D, 4E:
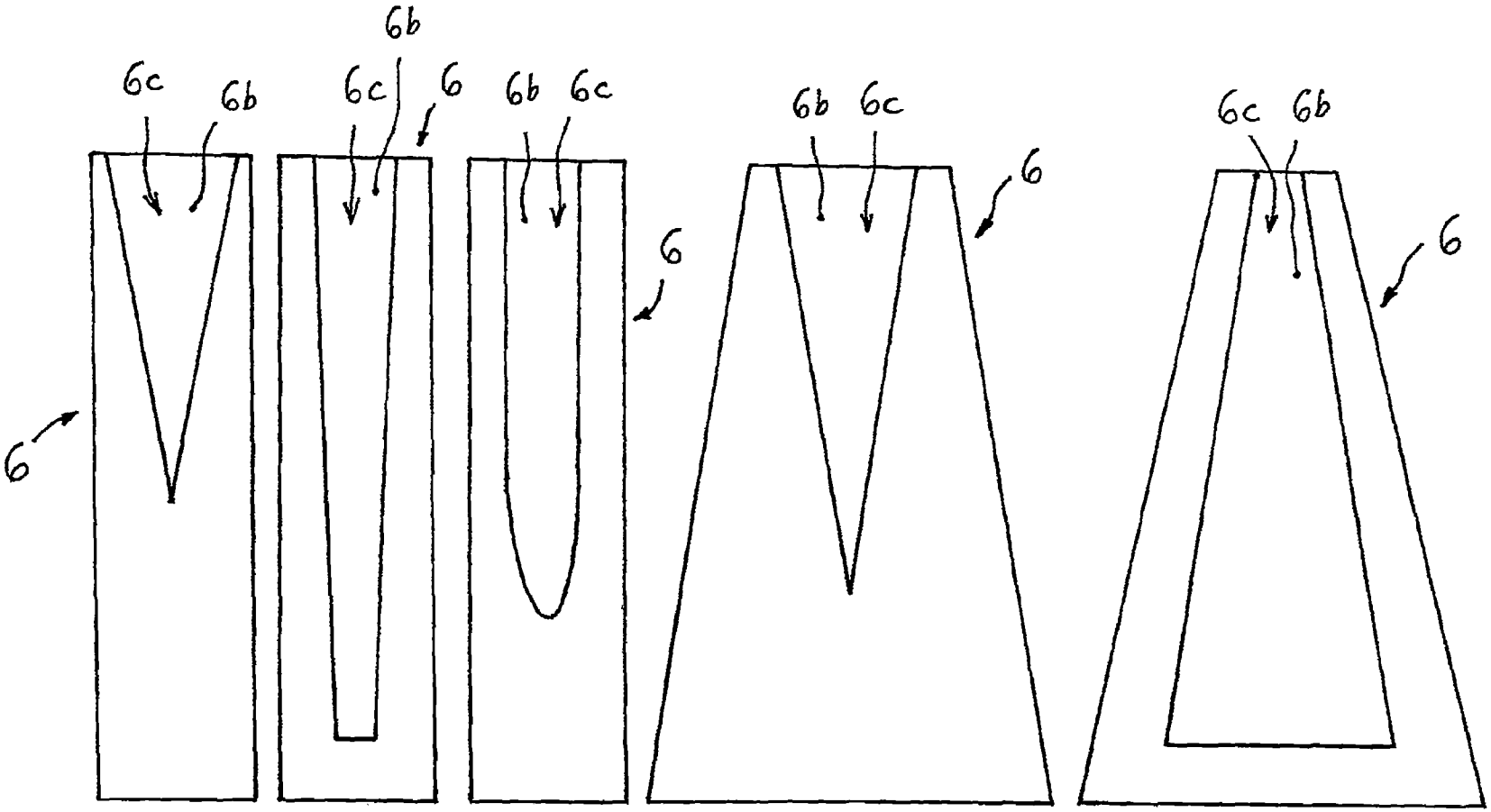
FIGS. 4*a*, 4*b*, 4*c*, 4*d*, 4*e* show material pieces.

FIGS. 3*a* and 3*b* show the adhesive tape of FIGS. 2*a*.1, 2*a*.2, 2*b*.1, 2*b*.2 in side and top views. The blowing direction is indicated with an arrow B. The base layer of the tape can be formed by a double-sided adhesive tape which is glued onto the surface of the reeling core 2 and whose upper surface is provided with an adhesive material, a glue, covered by a protective layer 6*b* of a suitable material, for example a back paper coated by a release material, as known from self-adhesive labels, the release material lying against the adhesive. The base layer, whose upper surface is provided with the adhesive area 6*a*, is provided with a suitable notch, on top of which the protective layer 6*b* extends to provide an air pocket 6*c*. The protective layer 6*b* is preferably attached to the adhesive tape in such a way that it remains fixed to the adhesive tape, to the rear edge of the base layer, even after it has been released. Thus, the protective layer does not remain floating loose after its removal. FIG. 3 shows how the rear edge of the protective layer can be folded underneath the base layer of the adhesive tape 6. If the edges of the protective layer and the base layer are aligned, the releasing of the protective layer can be prevented by turning both the protective layer 6*b* and the base layer underneath the base layer at the rear end of the adhesive tape; in other words, the adhesive tape is folded at this point.

If it is not desired that the protective layer 6*b* and the base layer, partly overlapping each other in the opened adhesive tape, mark the bottom of the reel (thicker point at the rear edge of the adhesive area 6*a*), the base layer and the protective layer can be made of a uniform material which is folded, wherein in the opened adhesive tape, the protective layer remains attached to the base layer at the fold. This alternative is illustrated in FIGS. 2*b*.1 and 2*b*.2. Consequently, the basic material of the adhesive tape is a uniform piece whose one edge is provided with a suitable cut-off portion to provide the air pocket 6*c*. Before folding the piece, the surfaces to be folded together are equipped with a suitable adhesive agent A (base layer) and a release agent E (protective layer 6*b*). A finished self-adhesive label 6 is shown in FIG. 2*b*.2. Adhesive agent is also applied underneath the base layer (on the surface coming against the reeling core). To facilitate the use, this bottom side may also be covered with a protective layer 6*d* which may comprise a similar release agent E to come against the adhesive agent as in the protective layer 6*b*. The air pocket 6*c* can also be formed without cuts to be made in the half forming the base paper, by shifting the folding point of the straight piece "off" in such a way that the protective layer extends outside the edge of the base layer. This is naturally taken into account in the dimensions of the areas covered by the materials A and E, because they come on different sides of the folding line in the straight piece. The basic material used in the adhesive tape may be papers that are commonly used in self-adhesive labels.

Irrespective of the structure of the tape 6, the need to detect it directly, as shown in FIGS. 1*a*, 1*b*, 1*c*, can be taken into account in its manufacture. Thus, the outer surface of the piece or section forming the protective layer 6*b*, i.e., the surface that is visible in the finished tape, may be equipped with a suitable color or a luminescent property to achieve the above-described aims. The same can be taken into account in the properties of the base layer, if the transparency of the protective layer 6*b* is sufficient.

An advantage of using the adhesive tape is that it remains attached to the reeling core and thus will not enter, for example, a pulper together with parts of the web. The adhesive used in the lower side of the base layer (base paper) may be such a pressure sensitive adhesive which has good hold in the direction of the plane of the base paper (in the peripheral direction of the reeling core) but which can be easily detached from the reeling core by pulling in the radial direction.

FIGS. 4*a*-4*e* show, seen from below, various alternatives for the structure of the base layer of the tape 6. The air pocket 6*c* (the cut made in the base layer) can be provided with various shapes, but the common feature is that it must open to the front edge of the tape 6 so that air can penetrate under the protective layer 6*b* in the blowing. The general shape of the base layer of the tape may also vary.

Figure 5:
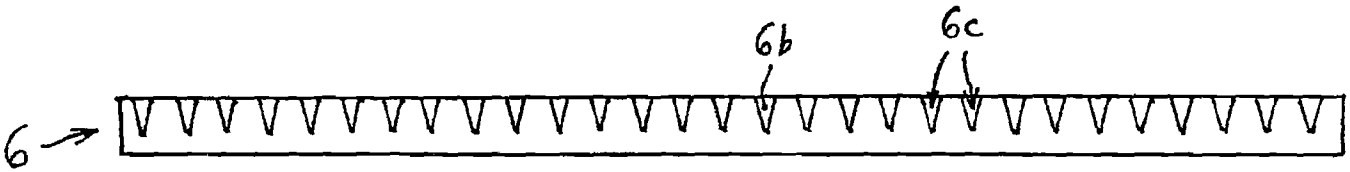
FIG. 5 shows one embodiment of a tape of the invention seen from below (without the protective layer of the base).

FIG. 5 shows one embodiment of the tape seen from below (without the protective layer 6*d* of the base), wherein the tape 6 consists, in a way, of a series of tapes shown in FIG. 3; in other words, the uniform tape extending in the axial direction of the reeling core comprises several air pockets 6*c* next to each other, provided by cut-off portions or notches formed in the base layer and opening in the direction of rotation. By means of the adhesive tape of FIG. 5, the adhesion is achieved on a wider area of the web. It can be used for a change with thin grades by forming a band of a corresponding width by a cutting device and by causing the tearing off of the band when the adhesive area 6*a* pulls the band with it after the nip N. The nozzle or nozzles of the blowing device 5 may be arranged to be effective on a wider area in a corresponding way. In view of tissue papers, even a full-width change is feasible, wherein the adhesive tape 6 extends substantially over the full width of the web W.

Also in the embodiments of FIGS. 4*a*-*e* and 5, the protective layer 6*b* covers the cut made in the base layer and the adhesive area 6*a* of the base layer, and it is removed by turning it by blowing behind the base layer, seen in the direction of rotation of the reeling core, as presented above.

Figure 6A:
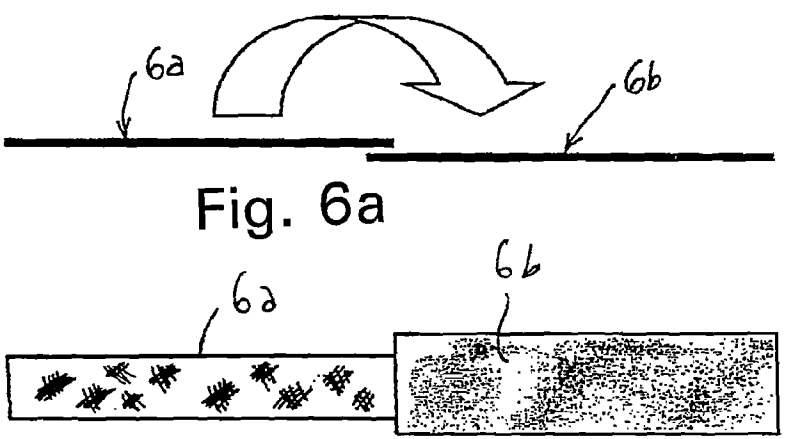
FIG. 6*a* is a side view, and 6*b* is a top view of an embodiment in which the blowing comes against the rotary movement of the reeling core diagonally from both sides to the respective air pockets.
Figure 6B:
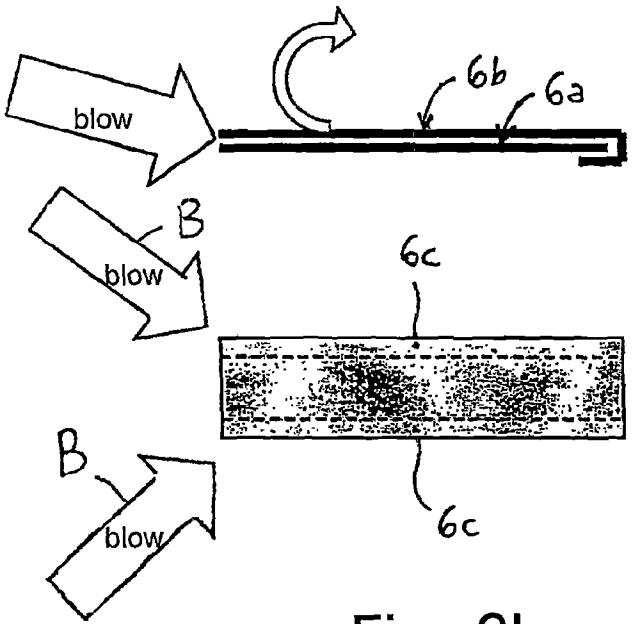

FIGS. 6*a*-*b* show an embodiment in which the blowing is not effected in the direction of the periphery, against the rotary movement of the reeling core, but it comes against the rotary movement of the reeling core diagonally from both sides (arrows B), to the respective air pockets. The principle of the method, with respect to the adhesion and the synchronization of the cutting of the web W, is exactly the same as above, and the difference lies only in the direction of the blow and the structure of the adhesive tape. In this case, the air pockets 6*c* have been formed taking into account the blowing direction; i.e. the gap underneath the protective layer 6*b*, into which the air penetrates in the blowing, must be open against the blowing direction. In this case, the protective layer 6*b* extends outside the adhesive area 6*a* and the whole base layer of the adhesive tape without shaping of the base layer; that is, also in this case the gap is formed between the protective layer 6*b* and the surface of the reeling core 2. In FIG. 5, the protective layer 6*b* is wider than the base layer, wherein the air pockets 6*c* are formed on the longitudinal edges of the adhesive tape 6.

FIGS. 7*a*.1-5 show some embodiments of adhesive tapes in the case of blowing diagonally from the front. The adhesive tapes are shown as seen from below; that is, they show the areas in which the protective layer 6*b* extends over the edges of the base layer.

The blowing can also be effected directly from the side in the axial direction, that is, not necessarily against the rotary movement, as long as the adhesive tape 6 has an air pocket 6*c* facing the blowing direction. The blowing is effected from both sides, wherein the air pockets 6*c* are at the sides of the adhesive tape 6.

The blowing device 5 is arranged to correspond to the releasing method (the structure and placement of the adhesive tape), either by using an existing gooseneck, by modifying it to be suitable for the removal of the tape, or by constructing a new blowing device. The number and placement of nozzles is arranged to correspond to the shape and the placement of the adhesive tape.

It is possible that, for some reason, the change is not successful, that is, the web does not follow the reeling core 2, which may, in the worst case, result in a web break. FIGS. 7*b*.1-3 show an arrangement for improving the change reliability. Adhesive areas of the adhesive tape can be exposed step by step. If the change is not successful after the exposure of the first adhesive area, it is possible to try again. In the structure of the adhesive tape, the protective layer 6*b* covering the uniform adhesive area 6*a* consists of two parts. In its structure, it resembles the adhesive tape of FIG. 6 and the adhesive tape at the left in FIG. 7*a*; that is, the protective layer 6*b* extends farther than the base layer at both edges. The protective layer consists of separate halves 6W and 6V, because it is split longitudinally in the middle. Either half of the protective layer can be removed by blowing from the respective side (maintenance side or driving side of the machine). Thus, only the part of the adhesive area 6*a* under this half is exposed. If, for some reason, the web is not turned up onto the new reeling core 2 after this, it is possible to remove the second part of the protective layer 6*b* by blowing from the opposite side, whereafter the part of the adhesive area 6*a* under it is available.

FIGS. 7*b*.1-3 show this method in steps. FIG. 7*b*.1 shows a situation in which the adhesive tape 6 is intact. The running direction of the surface of the reeling core 2 (the direction of rotation of the reeling core) is indicated with an arrow. In FIG. 7*b*.2, the first part 6*b*' has been removed and a section of the adhesive area 6*a* has been exposed. In FIG. 7*b*.3, also the remaining part 6*b*" of the protective layer is being detached.

FIG. 7*b*.2 shows how the blowing can be directed diagonally from the front (arrows B), i.e. against the direction of rotation of the reeling core. If only one of the parts of the protective layer is to be removed, the blowing is effective on that side only (on the right hand side in the middle figure). FIG. 7*b*.3 shows also an auxiliary device which may be used in all the above-described change methods, if the adhesive tape has such a structure and is attached in such a way that the protective layer 6*b*, or a part of it, does not remain attached to the base layer after the removal. The loose piece consisting of the protective layer is taken up by a suction device or a suction nozzle 11 which is brought suitably close to the adhesive tape 6 and whose suction is effective in the same direction as the removal blow B. Thus, the material piece consisting of the protective layer 6*b* or a part of the same and removed from the top of the adhesive area 6*b* will not remain floating as "chaff", but it can be sucked off in a controlled way and guided away via a suction channel, such as a tube or a hose, from the vicinity of the reeling core 2. In FIG. 7*b*.3, the rear edge of the adhesive tape 6 is just in front of the suction orifice of the nozzle 11 after the blowing has taken place.

If a narrow strip is cut off the web for the purpose of adhering to a part of the adhesive area 6*a* in the change, the location of the strip in the axial direction of the reeling core can always be repositioned quickly by transferring the cutting means so that it corresponds better to the location of the exposed adhesive area.

By means of the suction shown in FIGS. 7*b*.1-3, the material of the protective area 6*b*, or a part of it, can be totally removed from the reeling process. Thus, it will not be necessary to secure the attachment of the protective layer by specially structured adhesive tapes or by folding the straight-cut rear end of the adhesive tape, which causes an increased material thickness that is left to mark the web at the bottom of the reel.

When the structure of the adhesive tape is constant in the transverse direction, as in the left adhesive tape of FIG. 7*a* and in the adhesive tape of FIG. 7*b*, it is possible to manufacture an adhesive tape material that is continuous in the longitudinal direction, that can be stored on a roll and from which a tape 6 of a desired length can always be separated e.g. by cutting before the reel change. Thus, it is also easy to automate the attachment of the adhesive tape to the reeling core 2.

The invention is not limited to the above-described embodiments, but it may apply methods and auxiliary means to achieve the same functions and the same end result. For example, it is possible to remove the protective layer from the top of the adhesive surface also by other means than by blowing, for example by a mechanical contact. Thus, the removal method is taken into account in the design of the adhesive tape. Similarly, the position of the adhesive area on the reeling core in the change position does not necessarily need to be monitored continuously, if the speed of rotation of the reeling core and the position of the adhesive area at least once during the rotary motion of the reeling core are known exactly. It is thus possible to calculate when the adhesive tape enters the range of action of the blowing or another removal method and/or when the adhesive area (activated adhesive tape) enters the nip.

With paper grades of light weight, cuts (tongue, band) made in advance are not necessarily needed, but the web W can be made to tear and to follow the reeling core 2 as a result of adherence only. The tearing of the web to the edges can thus be aided by widening blows after the nip N.

Figure 8:
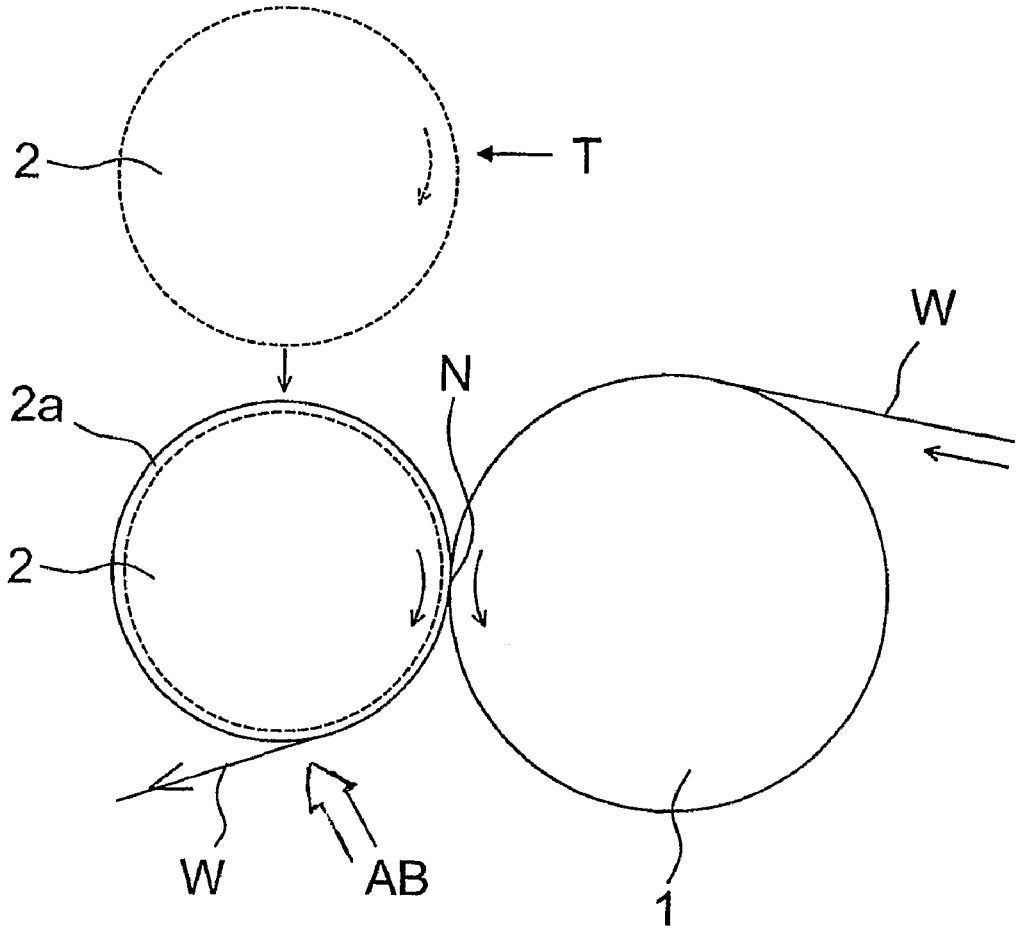
FIG. 8 is a side view of the reel-up, showing a second embodiment of the invention.

FIG. 8 shows a method in which the material on the surface of the reeling core 2 and changed to be adhesive at a desired moment, is the roll coating 2*a* itself. Before the reel spool is brought to the change position, it is heated (arrow T), wherein the coating becomes tacky. The heating can be implemented simultaneously when the rotational speed of the reeling core 2 is accelerated to the peripheral speed corresponding to the running speed of the web. Subsequently, when the reeling core 2 is brought into contact with the paper web, at the latest when the nip N is closed, the paper web is entrained in the rotary movement of the reeling core 2. The contact of the reeling core with the paper web or the nip contact (closing of the nip) causing the adherence can be timed to take place at such a moment when the tongue or tip separated from the web by cutting enters the point of contact. Thus, it will be sufficient that the reeling core is coated with said coating of a special material on a zone of a corresponding width only, and the rest of the coating could be made of a more common material, for example a normal plastic coating. In a corresponding manner, a full-width special material coating can be used to tear the web of a light-weight paper grade simultaneously as the web follows the reeling core. FIG. 8 shows, with an arrow, an auxiliary blow AB directed from below (from the opposite side if the web with respect to the reel spool 2), to aid the transfer of the web to the reel spool 2.

The reel spool 2 can also be heated when it is already in nip contact. Thus, when the coating becomes sufficiently tacky, the web adheres to the reel spool.

The advantage is that the surface of the reel spool becomes tacky first at the moment of the change and not before it, wherein the tackiness of the surface is not harmful when the reeling cores, for example reel spools, are in a storage.

The coating may be a special polymer with such physical properties that it becomes tacky at a certain temperature. These kinds of special polymers are known, for example, from plasters which are made to detach from the skin by cooling below a change temperature. These polymers, which are disclosed, for example, in EP patent 471 757 and U.S. Pat. No. 6,572,600, are characterized by a narrow transformation range and a reversible transformation. When the polymer is cooled, it is in an untacky state again. In a reel change, this recovery of the properties does not cause any harm, because by that stage, the fiber material web W has already been reeled several rotations around the reeling core 2. The method is very suitable for the change of smooth paper grades which are relatively easy to remove from the surface of the reeling core after the cooling of the polymer, for example, for coated grades.

It is also possible to use polymers which become reversibly tacky by the effect of another external stimulant, such as pressure, or water/chemicals or electric current/magnetic field. When the external stimulant is no longer effective on the coating, the polymer will revert to its initial state again. If the factor is temperature, the detachment of the web from the reeling core can be aided by cooling, if necessary.

Figure 9:
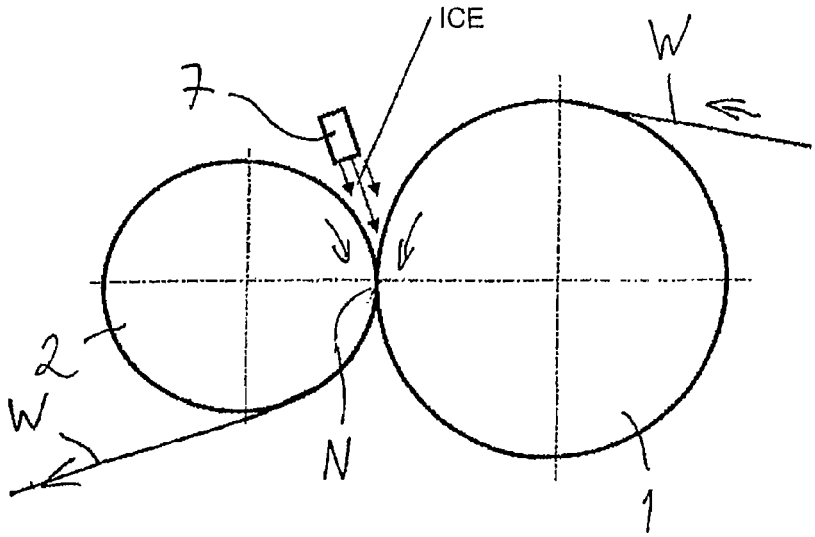
FIG. 9 shows a third embodiment of the invention.
Figure 11:
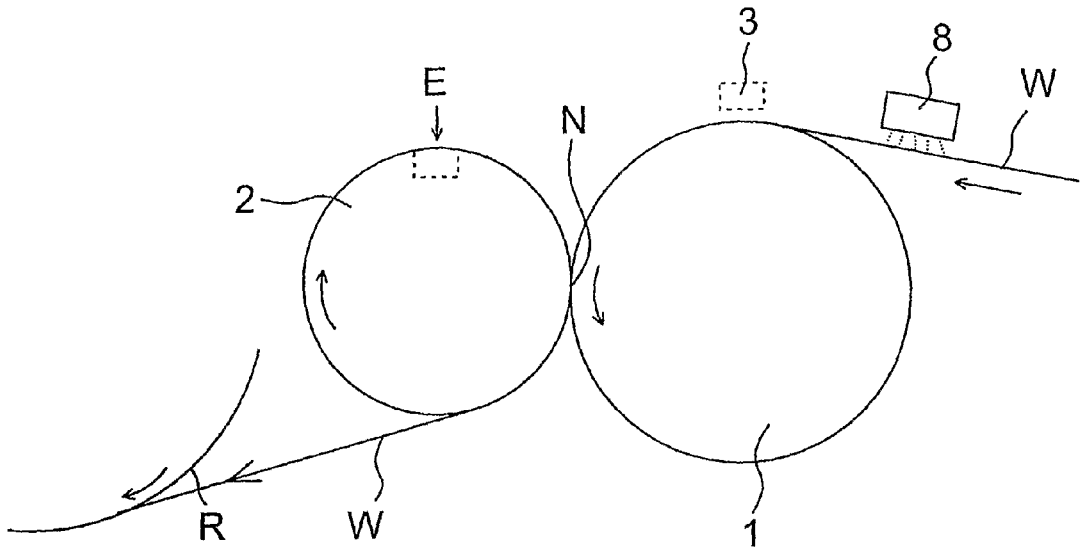
FIGS. 11 and 12 illustrate the fourth embodiment of the change method.

FIG. 9 shows a change method, in which material is brought onto the surface of the new reeling core 2 that, under pressure, becomes liquid in the nip N between the reeling core 2 and the web guiding member 1, by the effect of the linear pressure of the nip. When the effect of the pressure is stopped, the material changes its state to solid again. Because the liquid material both adheres to the solid surface of the reeling core and is absorbed into the fiber material layer running on the reeling core in the nip, the solidification causes adherence to the surface of the reeling core 2, when the web W, as shown in FIG. 9, after the reduction of the nip pressure follows the periphery of the reeling core 2 in a certain sector and at a certain tension after the nip, before it is directed towards the old reel R (such as shown in FIG. 11). The most common example of a material that changes its state by the effect of pressure, is ice (it becomes water which will be frozen again). The reel-up shown in FIG. 9 comprises a material feeding device 7 which is placed above the nip N between the web guiding member 1 (reeling cylinder) and the new reeling core 2, wherein it feeds the material at a desired moment into the nip N, between the web W and the reeling core 2.

In the case of light-weight paper grades, the web can be brought to breaking easily as a result of adhesion, without separate incisions of the web. However, it is possible to synchronize cutting performed on the web before the nip N in such a way that a certain point of the cut enters the nip N at the same moment when the solid material is fed into the nip. In this, it is possible to take steps which are analogous to the above-presented adhesive tape change. Thus, the material supply is thus limited in width direction to the zone to which e.g. the tongue or tip, separated from the web W before the nip, comes. Similarly, it is possible to separate a continuous band in the middle area of the web and to limit the material supply in the cross direction to the location of the band.

Figure 10A:
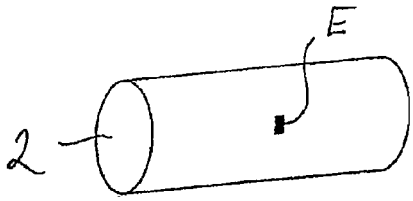
FIGS. 10*a*, 10*b*, and 10*c* show reeling cores to be used in a fourth embodiment of the change method.
Figure 10B:
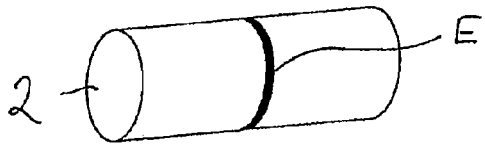
Figure 10C:
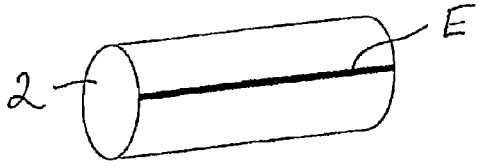

FIGS. 10*a*, 10*b*, and 10*c* show reeling cores which can be used in a method in which the web is attached by freezing to the surface of the reeling core, to a cooling element E provided in the surface. The change situation may be the same as that shown in the preceding FIG. 9, but in this case, no solid material is supplied into the nip N. The change by freezing attachment is achieved by supplying a liquid substance onto that surface of the paper web W that comes against the reeling core 2 in the change position. After coming into contact with the cooling element E, the substance freezes and is fixed onto the surface of the reeling core. The web can be moistened by subcooled water or ice crystals melting to water on the surface of the paper web before the contact with the cooling element. The cooling element E may constitute an area of a given size on the surface of the reeling core (FIG. 10*a*), as a zone of a given width extending in the direction of the periphery around the reeling core (FIG. 10*b*), or an area in the axial direction (FIG. 10*c*) or alternatively extending spirally, also in this case from one edge to the other edge of the reeling core. The embodiments of FIGS. 10*a* and 10*b* are suitable for turning a tongue or tip or a band attached at its front edge that are cut from the web before the nip N, up to the reeling core, and the of FIG. 10*c* is suitable for the so-called full-width turn-up (the web adheres over its full width and is torn), which is suitable for thin grades. The cooling element E is made of a material which differs, with respect to its thermal conductivity, from the rest of the surface material of the reeling core; and is, for example, a metal. The reeling core 2 may be, for example, the reel spool of a continuous reel-up. The materials may include stainless steel, aluminum, or copper.

Figure 12:
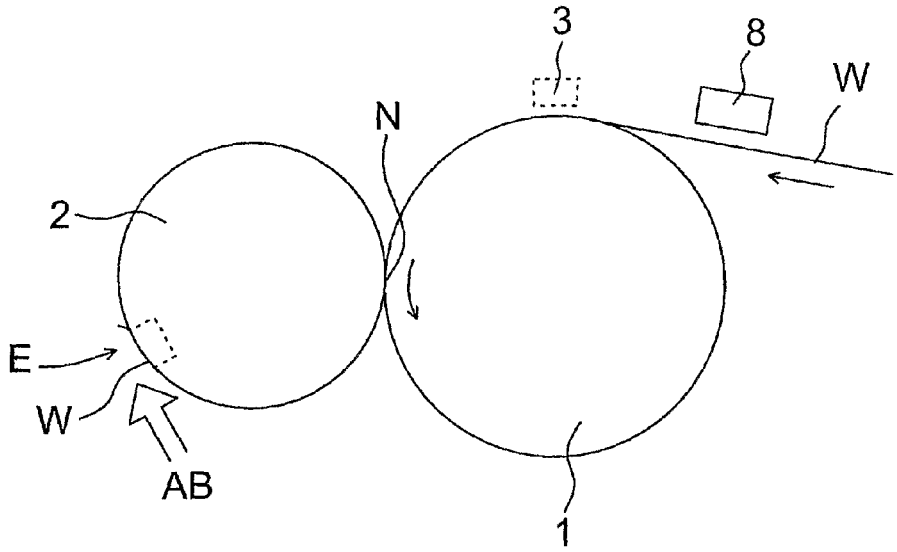

FIGS. 11 and 12 show, in side views, a web change to one of the reel spools shown in FIGS. 10*a*-10*c* in a continuous reel-up of a fiber material web. Before the nip N, the feeding device 8 is used for supplying said freezable substance (FIG. 11) onto the surface of the web W. After the nip N, the web extends at a certain tension against the reel spool 2 in the change position over the length of a given sector, after which it is directed towards the old reel R becoming full. In this area, the web has time to freeze to the reel spool 2 at the cooling element E, the web breaks, and it starts to follow the reel spool 2 (FIG. 12). An auxiliary blow AB corresponding to that in FIG. 8 is indicated by an arrow also in FIG. 12. It is advantageous that the substance to be fed by the device has time to be absorbed in liquid form to the web to some extent, because this promotes the adhesion.

The element E can be cooled from the outside of the reeling core 2, for example by blowing cold air to it, for example by a known Vortex tube, in which the flow of supplied pressurized air is converted to hot and cold streams at opposite ends of the tube, wherein temperatures below −30° C., even about −40° C. can be achieved by the cold stream. One alternative is to press dry ice, i.e. solid carbon dioxide, directly against the cooling element E, or the structure of the cooling element E may be hollow so that it is filled with said substance.

Another alternative to achieve temperatures of −30° C. or below is to use liquid nitrogen (−196° C.) for cooling the cooling element. In practice, the element is cooled by a separate cooling actuator which is pressed into contact with the element before the placement of the reeling core to the change position, for example in the storage of reeling cores or in a primary reeling device.

All the measures for cooling the cooling element E to a sufficiently low temperature can be taken before the reeling core is accelerated to the required peripheral speed and placed in contact with the web. Furthermore, it is possible to use cuts made in advance in the web according to the same principles as those described above, and to match the cut (and the liquid substance) to the cooling element E. Broken lines show a corresponding cutting device 3 for cutting the web against the surface of the reeling cylinder 1, which may be implemented in the way described above in connection with the adhesive tape change.

The method of FIGS. 11 and 12 is also suitable for a so-called wire reel-up, which also has a long contact when the wire presses the web in a given sector against the reel spool.

In the embodiments of FIG. 10*a*-*c*, the reeling core 2 may also be a winding core, such as a cardboard core, used in winding after a slitter. It may also be a winding core for the reel-up of tissue paper.

When inert substances (water/ice, carbon dioxide) are used in a cooling/solidification change, no harm will be caused later on. Also, the melting of the connection between the surface of the reeling core and the fiber material web later on will not disturb the reeling, because at that stage, several rotations of the web will already have been wound around the reeling core.

Figure 13:
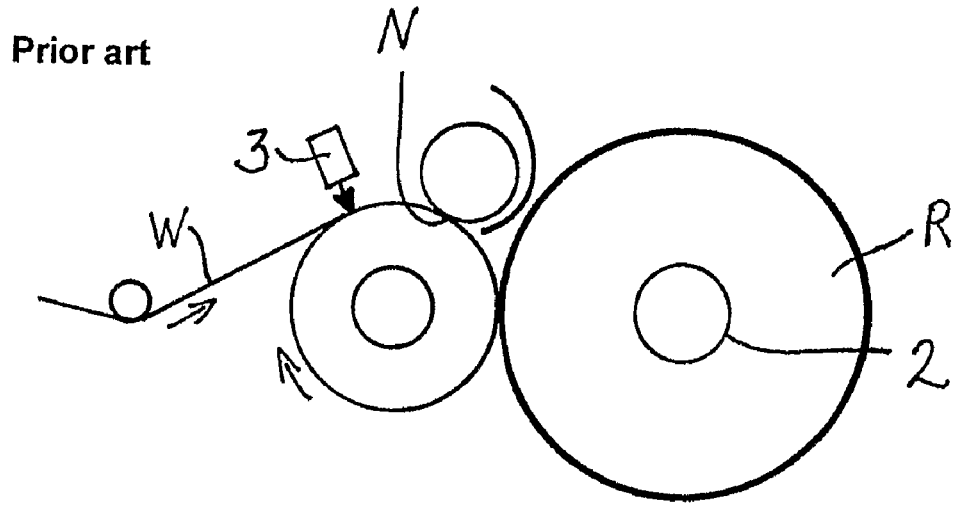
FIG. 13 shows a change method according to prior art.

FIG. 13 shows, for the sake of clarity, a change method of prior art, the so-called gooseneck change, which has already been referred to above. The fiber material web W entering the reel-up, for example a paper web, is cut by a cutting device 3, from which a tongue or a tip, a "wedge", is formed in the central area of the web by the above-described principles, and is blown by a blowing device 5 (gooseneck) around the new reeling core 2. It is also possible to cut a band in the middle area of the web, to be cut off after the nip and to be blown by the gooseneck onto the surface of the reeling core. The cutting can be performed according to the principles presented in the above embodiments, for example by water cutting against the surface of the reeling cylinder 1.

A problem in the change carried out with the help of blowing only is that in the case of thin grades, the blowing tends to tear the intact web on both sides of the tongue or tip, or "wedge". Therefore, for example in the case of tissue paper, it is almost impossible to use a gooseneck for turn-up of the web.

Figure 14:
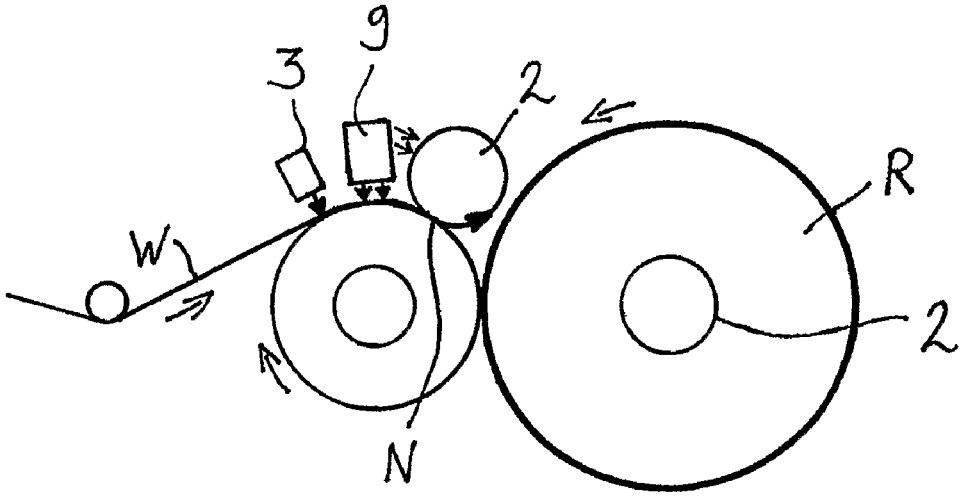
FIG. 14 is a side view of the reel-up, showing a fifth embodiment of the change method.

FIG. 14 shows a change method according to the invention, in which the tongue or tip is charged with static electricity after the cutting point. Between the cutting device 3 and the nip N there is a web charging device 9, which treats a part separated from the web W by cutting, which part may be said tongue or tip or band. An advantage compared with the use of blowing is that the intact web at the edges of the tongue or tip is not torn, as may easily occur by blowing, but the wedge can be neatly turned up onto the new reeling core 2 and the web can be made to follow it in a controlled manner by widening the cutting to the edges of the web W. A band can also be turned up onto the reeling core 2, if it is cut after the nip N, for example by water cutting in the cross direction of the band. In this way, the production of "chaff", i.e. loose pieces detached from the fiber material web, is avoided.

For charging the surface of the web W, it is possible to use known corona point electrodes. The reeling core 2 (reel spool) is thus preferably coated with a metal, at least in the zone hit by the tongue or tip or band in the nip N, in which case the core is in the earth potential.

If necessary, however, it is also possible to provide the surface of the new reeling core 2 (reel spool) with an electric charge that is opposite in sign to the web, which improves the adhesion between the web and the surface of the reeling core, and this can be implemented by the same device 9 that is placed above the reeling cylinder and whose other electrodes are directed towards the reeling core 2. It is also possible to charge the surface of the reeling core 2 only.

Figure 15:
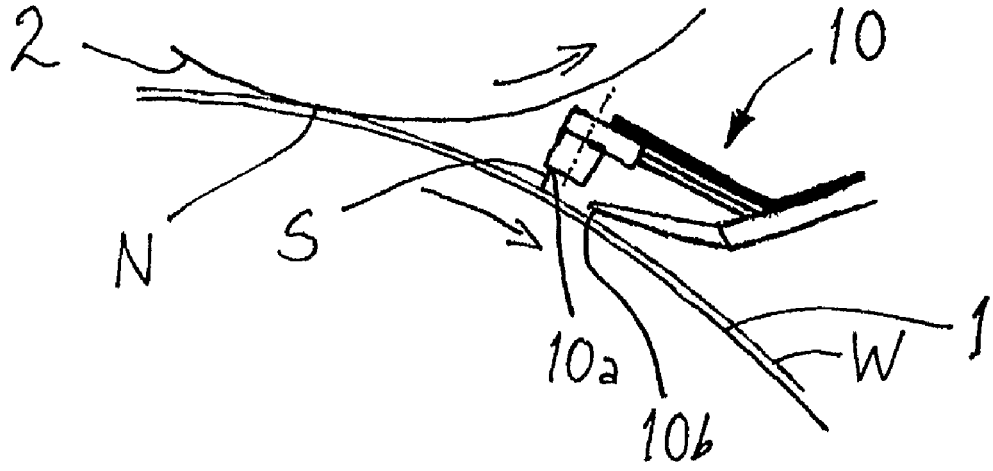
FIG. 15 is a side view of the reel-up, showing an advantageous way of transferring the web to a reeling core when the method of FIG. 1*c* is used.

Finally, FIG. 15 shows a way of cutting and turning the band separated from the web before the nip up onto the reeling core 2 (reel spool). This can be used to help the transfer of the web onto the reeling core at the band separated by two longitudinal cuts in any of the above-described change methods, in which the aim is to cut the tape after the nip and to transfer it onto the reeling core by means of the adhesion between the fiber material web and the surface of the reeling core, which adhesion may be based on any of the above-described phenomena. However, it can also be thought to be used, with suitable arrangements, as the only auxiliary means for turn-up of a band that is narrower than the fiber material web onto the reeling core.

In the method, the tape is cut after the nip, wherein it is not necessary to cut a tongue or a wedge before the nip, but the cutting device uses cutting points located at constant distance from each other in the cross direction of the web. Thus, it will not be necessary to take care of the transfer of a loose tongue or wedge into the nip and through the same, which requires, with thin (flexible) grades, at least cutting against the surface of a particular base or a web guiding member (reeling cylinder 1), and possible air blows towards the nip.

The change device 10, as shown in FIG. 15, which is used in the method, comprises a cutting nozzle 10*a* and a blowing nozzle 10*b*. The cutting nozzle is used to cut the web between the nip N and the point of impact of the blowing nozzle 10*b* with a material jet S which is advantageously a high-pressure water jet. The jet S cuts the web against the guiding member (reeling cylinder 1) in the cross direction of the web. Before the cutting, blowing with the nozzle 10*b* has been started against the travel direction of the web. After a sufficiently wide cut has been made in the web by the material jet S, the blow from the blowing nozzle 10*b* turns the web following the cut up onto the surface of the reeling core.

If a band has been formed in the middle section of the web by the cutting device 3, only a central blow with the blowing nozzle 10*b*, and no widening blows, will be needed to turn it up after the transverse cutting. The web is widened to its full width around the reeling core by widening the band by the cutting device 3 to a full-width web.

The cutting nozzle 10*a* has two alternatives. For example, it is possible to use a rotating nozzle body whose rotating axis is approximately perpendicular to the plane of the web. The nozzle 10*b* cuts continuously across a zone of a certain width, because it is in the rotating nozzle body at a certain distance from the axis of rotation. The body may comprise two or more nozzles at different stages of the rotary motion. When using such a cutting nozzle, the synchronization of the blowing and the cutting is not accurate, because one or more nozzles can cut the nozzle in a way continuously in the cross direction at a certain width. If this width is greater than the width of the band coming through the nip N, the nozzle(s) 10 cut the band continuously.

Another alternative is to use one nozzle 10*a*, either with a linear movement or a pivotal movement. In the latter alternative, that end of a bar which is directed towards the web is provided with the cutting nozzle 10*a*, and the other end of the bar with a rotating joint. The bar must be made sufficiently long so that the nozzle 10*a* remains sufficiently close to the surface of the reeling cylinder 1 at each point of its curved path of motion. In this way, a cut with a width of, for example, 150 mm can be made in the cross direction of the web W, and correspondingly, a wide, pre-cut band this wide can be cut off. When using a cutting nozzle 10*a* movable in the cross direction of the web and the band (linear movement or pivotal movement), the synchronization of the cutting and the turn-up blow must be more accurate to make the blow effective under the web W at the cutting point.

Both the cutting nozzle 10*a* and the blowing nozzle 10*b* can be connected to the same frame, for example an existing gooseneck device; that is, in the figure, in a change situation they have been brought in from above a new reeling core 2 into the gap opening after the nip N between the reeling cylinder 1 and a new reeling core 2. The material of the cutting jet S of the cutting nozzle 10*a*, such as high-pressure water, can also be introduced along the gooseneck device. A high-pressure water hose or tube can thus be connected in parallel with the air channel of the blowing nozzle 10*b*. In the case of a high-pressure water jet by means of a rotating nozzle device comprising one or more nozzles, the driving force required for the rotation of the nozzle device or the force required for the movement of the nozzle in the cross direction of the web (linear movement or pivotal movement) can be introduced through the same route. If a rotary high-pressure water jet is used, the medium producing the rotary movement of its nozzle body can be pressurized air (so-called pneumatically rotating jet). The driving force for rotating the jet can thus be taken from by the same source of pressurized air as the air used for the turn-up blow or for the turn-up and widening blow.

Figure 16:
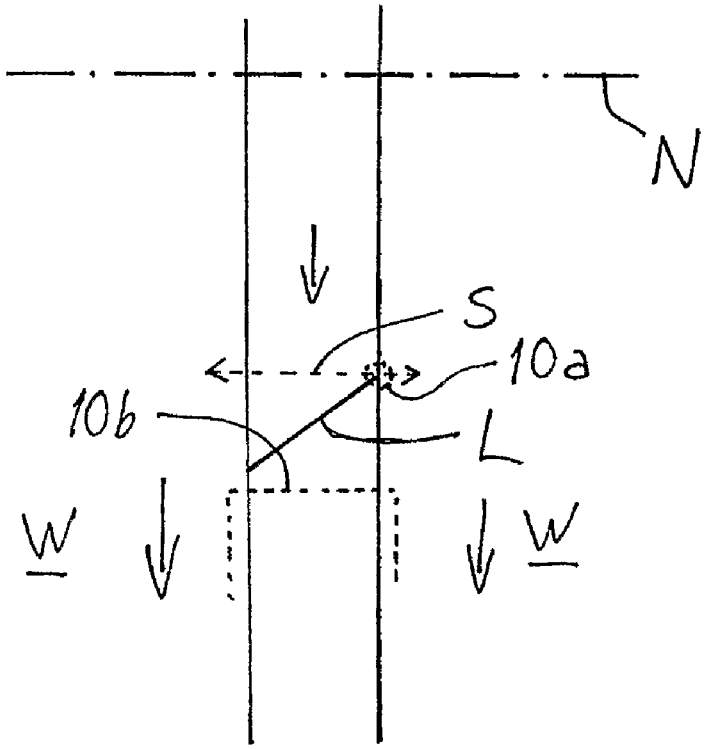
FIG. 16 illustrates the method of FIG. 15 in the plane of the web.

FIG. 16 shows a cutting line L obtained by a nozzle, in this case a nozzle 10*a* running straight directly across the band, and the position of the blowing nozzle 10*b*.

The above-described cutting nozzles give a secure cut, and it can be used to replace the cuts in the cross direction of the web before the nip, or punching knives used previously. At the same time, it is possible to reduce the risks of a web break due to cuts and incisions in the cross direction before the nip, because the cut extending in the cross direction of the web is made first after the nip N.

The method of FIG. 15 can also be used in turn-up of such a web onto a reeling core (reel spool) in which no band has been made by two longitudinal cuts, but the web is intact from edge to edge. This is suitable for thin paper grades. If the cut with the jet S in the cross direction is made in an intact web, the change device 10 must be used for normal turn-up and widening blow which is known from the use of a gooseneck as such. For this, the blowing device may comprise several blow nozzles 10*b* for turn-up and widening blow.

The figures show a reel-up, in which the member guiding the web in the reel-up is a reeling cylinder 1, against which the change nip N is formed. It is possible that a continuous flexible supporting member, such as a supporting wire, is led over the reeling cylinder 1 to supply the web to the reel-up. Also in this case, the change nip is formed against the reeling cylinder 1, but the fiber material web W is thus between the surface of the reeling core and the supporting member in the nip. The reel-up may also be a so-called wire reel-up, in which a guide roll of the wire loop corresponds to the reeling cylinder. It is also possible that the change is performed when the reeling core 2 is merely against a flexible supporting member in the reel-up, the supporting member pressing the fiber material web with a certain tension against the peripheral surface of the reeling core.

The invention claimed is:

1. A method for changing a reel in a reeling process of a fiber material web, using a reeling core having a surface with an adhesive area covered by a protective layer on top of an adhesive area, comprising the steps of:

passing the fiber material web to an old reel which is becoming full;

bringing the reeling core into a reel change position in relation to the old reel;

bringing the surface of the reeling core into a nipping contact with the fiber material web running on a surface of a web guiding member;

while the reeling core is rotating in the nipping contact with the fiber material web running on the surface of the web guiding member, removing the protective layer on top of the adhesive area, exposing the adhesive area to form an exposed adhesive area on the surface of the reeling core;

changing the fiber material web from passing on to the old reel to winding on to the reeling core by adhering at least a portion of the fiber material web to the exposed adhesive area of the reeling core;

forming a tongue in the fiber material web before the nipping contact so that the forming of the tongue is synchronized with the exposing of the adhesive area so that the exposed adhesive area hits an area of the tongue when the exposed adhesive area first passes through the nipping contact, adhering the tongue to the reeling core; and wherein a location of the adhesive area is detected during the rotation of the reeling core, and the forming of the tongue in the fiber material web before the nipping contact is synchronized with the location of the adhesive area.

2. The method of claim 1 wherein the fiber material web is cut off from the tongue all the way to the edges by at least one cutting device to make the whole fiber material web follow the tongue adhered to the surface of the reeling core.

3. The method of claim 1 wherein the step of removing the protective layer on top of the adhesive area is preformed by blowing the protective layer off the adhesive area.

4. The method of claim 3 wherein the step of removing the protective layer on top of the adhesive area is preformed by blowing on to a portion of the protective layer which does not overlie the adhesive area.

5. The method of claim 3 wherein the blowing takes place directly or diagonally against a direction defined by the rotating of the reeling core.

6. The method of claim 3 wherein the blowing takes place in an axial direction defined with respect to a rotation axis of the reeling core.

7. The method of claim 1 wherein the step of removing the protective layer on top of the adhesive area is preformed by blowing into a pocket formed between the protective layer and the surface of the reeling core.

8. The method of claim 7 wherein the adhesive area is formed by a base layer which has an adhesive layer underneath the base layer which adheres the base layer to the reeling core, and an adhesive layer on an upper surface of the base layer forming the adhesive area;

wherein the base layer is formed with portions defining a wedge-like narrowing cut-off that is covered by the protective layer; and wherein a nozzle of a blowing device blows in a direction opposite the rotation of the reeling core into an air pocket formed where the protective layer overlies the wedge-like narrowing cut-off, which opens toward the nozzle.

9. The method of claim 7 wherein the adhesive area is formed by a base layer which has an adhesive layer underneath the base layer which adheres the base layer to the reeling core, and an adhesive layer on an upper surface of the base layer forming the adhesive area;

wherein the base layer is formed smaller than the protective layer so that an air pocket is formed where the protective layer extends over the reeling core surface but not the base layer; and wherein a nozzle of a blowing device blows in a direction to blow air into the air pocket which opens toward the nozzle.

10. The method of claim 1 wherein the protective layer is arranged to remain attached to the reeling core after the step of removing the protective layer from the adhesive area.

11. The method of claim 1 wherein the step of removing the protective layer on top of the adhesive area is followed by sucking the protective layer from a vicinity defined by the reeling core such that the protective layer does not remain floating as chaff.

12. The method of claim 1 wherein the protective layer on top of the adhesive area passes at least once through the nipping contact before the removal of the protective layer.

13. The method of claim 1 wherein the removal of the protective layer from the top of the adhesive area is also synchronized with the location of the adhesive area during the rotation of the reeling core.

14. The method of claim 1 wherein the location of the adhesive area is detected optically directly from the surface of the reeling core.

15. The method of claim 1 wherein the location of the adhesive area is detected with a photocell that detects an optical property of the adhesive area or the protective layer that differs from the rest of the surface of the reeling core.

16. The method of claim 1 wherein in a first step a first adhesive area is exposed, and if the fiber material web does not start winding on to the reeling core, a second adhesive area is exposed.

17. The method of claim 16 wherein the first adhesive area and the second adhesive area are exposed as different parts of a uniform adhesive area.

18. The method of claim 1 wherein the step of forming the tongue comprises making a cut that is at least partly in a cross direction with respect to the fiber material web.

19. The method of claim 18 wherein the tongue has a frontmost portion which is detached from the fiber material web before the nipping contact.

20. The method of claim 18 wherein the tongue is formed as a continuous band that is made to break after the adhering of the tongue to the reeling core.

21. The method of claim 18 wherein the tongue is formed as a continuous band which, after forming, and after the nipping contact, is cut so the band is detached from the fiber material web.

22. The method of claim 21 wherein the step of cutting the tongue is performed with a material jet against the surface of the web guiding member.

23. The method of claim 22 wherein the transfer of the band to the reeling core is aided by blowing.

24. The method of claim 23 wherein the blowing is introduced by a nozzle placed after the nipping contact and after the material jet.

25. The method of claim 22 wherein the material jet is introduced from a nozzle moving in a cross direction with respect to the fiber material web.

26. The method of claim 25 wherein the nozzle is moved in the cross direction of the fiber material web by a linear movement, a pivotal movement, or a rotary movement.

* * * * *

UNITED STATES PATENT AND TRADEMARK OFFICE

CERTIFICATE OF CORRECTION

PATENT NO. : 7,757,990 B2
APPLICATION NO. : 11/815425
DATED : July 20, 2010
INVENTOR(S) : Jari Tiitta et al.

It is certified that error appears in the above-identified patent and that said Letters Patent is hereby corrected as shown below:

Column 10, line 49, “separate halves 6W and 6V” should be -- separate halves 6b' and 6b" --.

Signed and Sealed this
Twenty-fourth Day of May, 2011

David J. Kappos

David J. Kappos
*Director of the United States Patent and Trademark Office*